US008711537B2

(12) United States Patent
Adachi

(10) Patent No.: US 8,711,537 B2
(45) Date of Patent: Apr. 29, 2014

(54) ESD PROTECTION DEVICE AND METHOD FOR PRODUCING THE SAME

(75) Inventor: Jun Adachi, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 231 days.

(21) Appl. No.: 13/410,572

(22) Filed: Mar. 2, 2012

(65) Prior Publication Data

US 2012/0236450 A1 Sep. 20, 2012

(30) Foreign Application Priority Data

Mar. 14, 2011 (JP) ..... 2011-055821
Nov. 17, 2011 (JP) ..... 2011-251382

(51) Int. Cl.
*H02H 9/06* (2006.01)

(52) U.S. Cl.
USPC ..... 361/118; 361/56; 361/91.1; 361/111

(58) Field of Classification Search
USPC ..... 361/56, 91.1, 111, 118, 119, 126, 127
See application file for complete search history.

(56) References Cited

U.S. PATENT DOCUMENTS 4,069,465 A * 1/1978 Kouchich et al. ..... 338/20
5,594,613 A * 1/1997 Woodworth et al. ..... 361/127
2009/0067113 A1 3/2009 Urakawa
2010/0309595 A1 12/2010 Adachi et al.
2011/0222197 A1 9/2011 Adachi et al.

FOREIGN PATENT DOCUMENTS

JP 2001-43954 A 2/2001
JP 2005-276666 A 10/2005
JP 2009-32508 A 2/2009
WO 2008/146514 A1 12/2008
WO 2009/098944 A1 8/2009
WO 2010/061550 A1 6/2010

* cited by examiner

*Primary Examiner* — Stephen W Jackson
*Assistant Examiner* — Tien Mai
(74) *Attorney, Agent, or Firm* — Keating & Bennett, LLP

(57) ABSTRACT

An electro-static discharge protection device includes a substantially rectangular parallelepiped base in which insulating ceramic layers are laminated, a pair of discharge electrodes that are located inside the base and that include facing portions facing each other, and outer electrodes that are located on surfaces of the base and that are electrically connected to the discharge electrodes. The base includes a cavity therein, and the facing portions of the discharge electrodes are exposed in the cavity. The base has an hourglass shape in which the thickness of the insulating ceramic layers is gradually decreased from an area near both ends of the base to a central portion thereof with respect to both a longitudinal cross section passing through the center in the longitudinal direction of the base and a lateral cross section passing through the center in the lateral direction of the base.

8 Claims, 14 Drawing Sheets

ESD PROTECTION DEVICE AND METHOD FOR PRODUCING THE SAME

BACKGROUND OF THE INVENTION

1. Field of the Invention

The present invention relates to an electro-static discharge (ESD) protection device to protect an electronic circuit or an electronic component from a surge. In particular, the present invention relates to an ESD protection device having improved resistance to breakdown caused by heat or shock during discharge, and a method for producing the same.

2. Description of the Related Art

In general, electrical devices may be damaged when subjected to an electrostatic discharge such as a surge. In such a case, electro-static discharge (ESD) protection devices may be used in order to protect circuit elements from an electrostatic discharge. ESD protection devices are devices in which an excessive voltage is conducted from a signal line to a ground line by utilizing a discharge phenomenon in order to protect circuit elements from static electricity.

A known ESD protection device includes insulating ceramic layers, a pair of outer electrodes provided on outer surfaces of the insulating ceramic layers, inner electrodes that are provided inside the insulating ceramic layers and that are electrically connected to the outer electrodes, a discharge space provided in the insulating ceramic layers (refer to, for example, Japanese Unexamined Patent Application Publication No. 2001-043954).

FIG. 1 is a perspective view of an ESD protection device 10 disclosed in Japanese Unexamined Patent Application Publication No. 2001-043954. FIG. 2 is an exploded perspective view of the ESD protection device 10. FIG. 3 is a cross-sectional view taken along line A-A in FIG. 1. As illustrated in FIG. 2, the ESD protection device 10 is a laminate of insulating ceramic sheets 2, an insulating ceramic sheet 3 having an opening 5, and an insulating ceramic sheet 4 having an opening 5 and inner electrodes 6. In the laminated state, as illustrated in FIG. 3, the pair of inner electrodes 6 is arranged inside insulating ceramic layers 7 so as to face each other, and facing portions of the inner electrodes 6 are exposed in a discharge space 8. Outer electrodes 1 that are electrically connected to the inner electrodes 6 are formed on end surfaces of the laminate. As illustrated in an ESD protection device 10*a* of FIG. 4, a portion of each of the inner electrodes 6 and an insulating ceramic layer 7 may be separated from each other in the discharge space 8.

When the ESD protection device 10 or 10*a* is mounted on a printed wiring board P, a gap d is formed between the laminate and the printed wiring board P.

In the ESD protection device having the existing structure disclosed in Japanese Unexamined Patent Application Publication No. 2001-043954, it is difficult to dissipate heat generated near the facing portions of discharge electrodes by a surge current flowing during the operation of ESD protection. Accordingly, when the surge current repeatedly flows within a short time, the calorific value in the facing portions of the discharge electrodes significantly increases, and thus melting of the electrodes or vitrification of the ceramic material may occur near the facing portions of the discharge electrodes. Cracks (microcracks) and breaking may also be caused by a thermal stress. These phenomena may cause a short-circuit defect.

SUMMARY OF THE INVENTION

In view of the above-described problems, preferred embodiments of the present invention provide an ESD protection device in which degradation of a discharge portion of the ESD protection device can be prevented and suppressed when a surge current repeatedly flows within a short time.

An ESD protection device according to a preferred embodiment of the present invention includes a substantially rectangular parallelepiped base in which insulating ceramic layers are laminated; at least one pair of discharge electrodes that are disposed inside the base and that include facing portions facing each other; and outer electrodes that are disposed on surfaces of the base and that are electrically connected to the discharge electrodes, wherein the base has a shape in which, among outer surfaces of the base, a central portion of an outer surface substantially perpendicular to a laminating direction of the insulating ceramic layers is depressed toward the inside in the laminating direction with respect to at least one of a longitudinal cross section passing through the center in the longitudinal direction of the base and a lateral cross section passing through the center in the lateral direction of the base.

The base preferably has a shape in which, among the outer surfaces of the base, central portions of two outer surfaces substantially perpendicular to the laminating direction of the insulating ceramic layers are depressed toward the inside in the laminating direction.

The base preferably includes a cavity therein, the facing portions of the discharge electrodes are preferably exposed in the cavity, and the facing portions of the discharge electrodes are preferably located in a central portion (constricted portion) of the base. With this structure, heat generated in the facing portions of the discharge electrodes rapidly reaches a surface of the base and is dissipated. Thus, degradation of the discharge portion can be further suppressed and prevented.

An auxiliary discharge electrode is preferably arranged so as to be adjacent to at least the facing portions of the discharge electrodes and a portion between the facing portions, and the auxiliary discharge electrode preferably includes conductive particles and at least one of insulating particles and semiconductor particles.

For example, the conductive particles may be particles including surfaces that are coated with an insulating material.

A method for producing an ESD protection device according to another preferred embodiment of the present invention includes a discharge electrode formation step of forming a pair of discharge electrodes facing each other on at least one of a surface of a first insulating ceramic layer and a surface of a second insulating ceramic layer; an auxiliary discharge electrode material-providing step of allowing an auxiliary discharge electrode material to adhere between facing portions of the discharge electrodes; a laminating step of laminating the first insulating ceramic layer and the second insulating ceramic layer in a state where the surface of the first insulating ceramic layer and the surface of the second insulating ceramic layer face each other to form a laminate; a dividing step of dividing the laminate into individual bases; an outer electrode formation step of forming outer electrodes that are electrically connected to the discharge electrodes on surfaces of a base obtained in the dividing step; and a firing step of firing the base including the outer electrodes thereon to form a cavity between the first insulating ceramic layer and the second insulating ceramic layer so that an end of each of the discharge electrodes is exposed in the cavity and to disperse the auxiliary discharge electrode material in the cavity, wherein the method includes a constriction step of depressing, among outer surfaces of the base, a central portion of an outer surface substantially perpendicular to a laminating direction of the insulating ceramic layers toward the inside in the laminating direction with respect to at least one of a longitudinal cross section passing through the center in the longitudinal direction of the base and a lateral cross section passing through the center in the lateral direction of the base.

For example, the constriction step may be a step of pressing the base in a die, the step being performed before firing in the firing step.

For example, the constriction step may alternatively be a step of arranging, on at least one of the first insulating ceramic layer and the second insulating ceramic layer, a material whose sintering shrinkage occurs later than the sintering shrinkage of a ceramic material of the first insulating ceramic layer and the second insulating ceramic layer.

According to various preferred embodiments of the present invention, since the discharge portion has a high heat dissipation performance and thermal shock resistance, it is possible to provide an ESD protection device in which degradation of the discharge portion is prevented and suppressed when a surge current repeatedly flows within a short time, for example.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

First Preferred Embodiment

Figure 1:
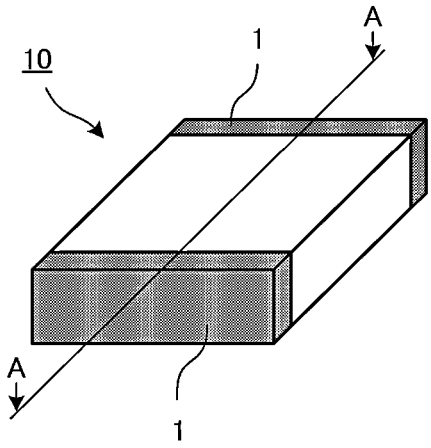
FIG. 1 Prior Art
FIG. 1 is a perspective view of an ESD protection device 10 disclosed in Japanese Unexamined Patent Application Publication No. 2001-043954.
Figure 2:
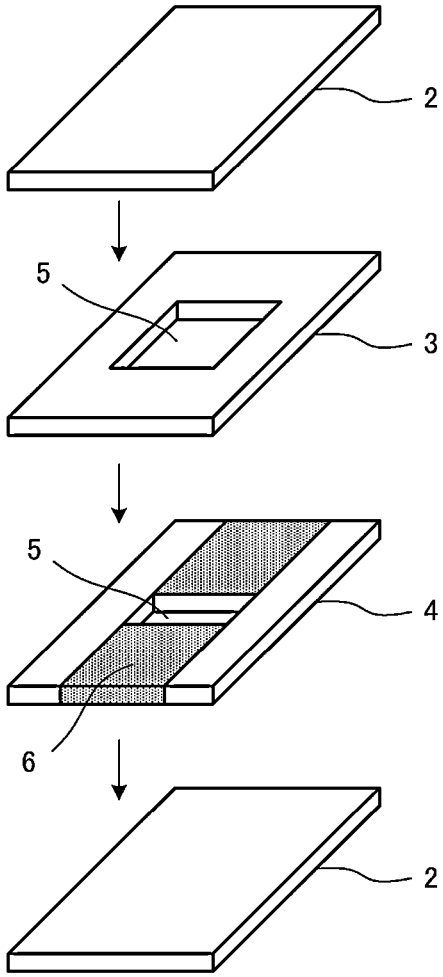
FIG. 2 Prior Art
FIG. 2 is an exploded perspective view of the ESD protection device 10.
Figure 3:
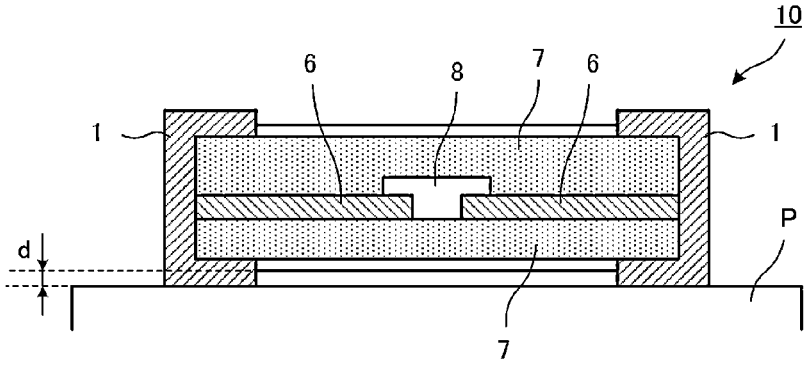
FIG. 3 Prior Art
FIG. 3 is a cross-sectional view taken along line A-A in FIG. 1.
Figure 4:
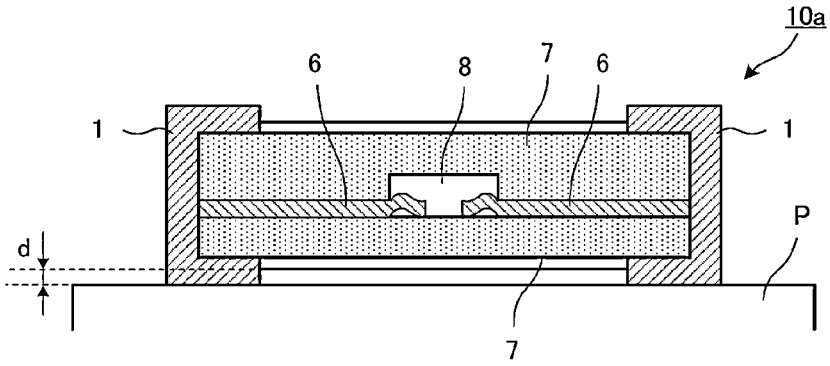
FIG. 4 Prior Art
FIG. 4 is a cross-sectional view of another ESD protection device in the related art.
Figure 5A:
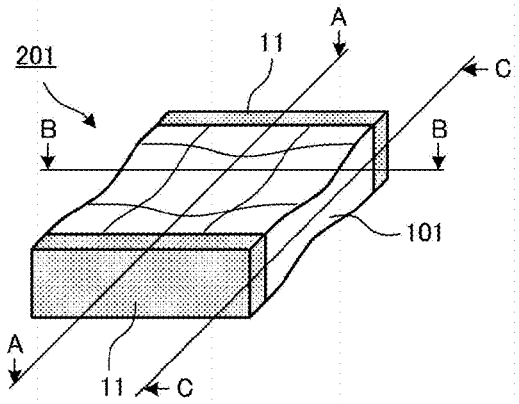
FIG. 5A is a perspective view of an ESD protection device 201 of a first preferred embodiment of the present invention.
Figure 6A:
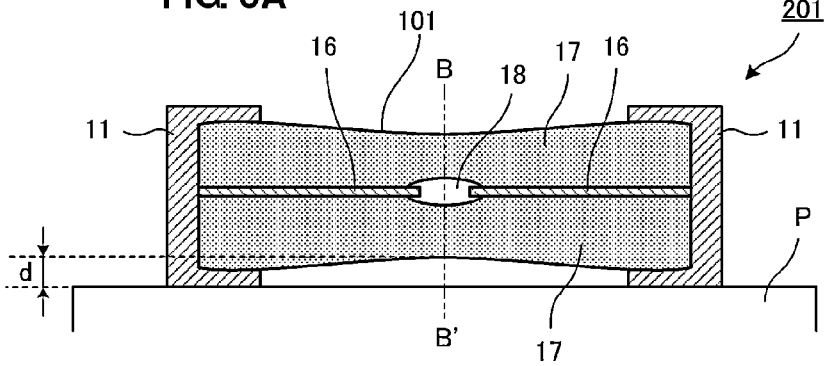
FIG. 6A is a longitudinal cross-sectional view of the ESD protection device 201 taken along line A-A in FIG. 5A.
Figure 6B:
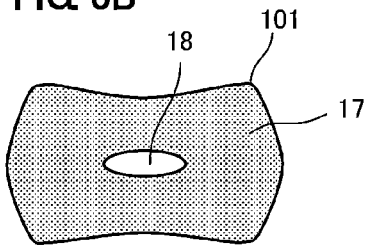
FIG. 6B is a lateral cross-sectional view of the ESD protection device 201 taken along line B-B in FIG. 5A.

FIG. 5A is a perspective view of an ESD protection device 201 of a first preferred embodiment. FIG. 6A is a longitudinal cross-sectional view of the ESD protection device 201 taken along line A-A in FIG. 5A. FIG. 6B is a lateral cross-sectional view of the ESD protection device 201 taken along line B-B in FIG. 5A. Line B-B' in FIG. 6A shows the position of the lateral cross section in the line B-B.

The ESD protection device 201 includes a substantially rectangular parallelepiped base 101 in which insulating ceramic layers 17 are laminated, a pair of discharge electrodes 16 that are located inside the base 101 and that include facing portions facing each other, and outer electrodes 11 that are located on surfaces of the base 101 and that are electrically connected to the discharge electrodes 16. The outer electrodes 11 are located on both ends of the base 101, the ends facing each other in the longitudinal direction. The base 101 includes a cavity 18 therein, and the facing portions of the discharge electrodes 16 are exposed in the cavity 18. The facing portions of the discharge electrodes 16 are located in a central portion (constricted portion) of the base 101.

As illustrated in FIG. 6A, the base 101 preferably has an hourglass shape in which a dimension of the insulating ceramic layers 17 in a laminating direction (the thickness dimension in a height direction perpendicular to a surface of a printed wiring board P) is gradually decreased (constricted) from an area near both ends of the base 101 to a central portion thereof with respect to both a longitudinal cross section passing through the center in the longitudinal direction of the base 101 and a lateral cross section passing through the center in the lateral direction of the base 101. However, in the first preferred embodiment, as illustrated in FIG. 6B, regarding a width of the base 101 in the lateral direction (the width extending in a direction parallel to a mounting surface on the printed wiring board P), the width in a central portion is larger than the width of the upper surface and the width of the lower surface with respect to a position in the height direction perpendicular to the mounting surface on the printed wiring board P. In addition, the width gradually increases from an area near both ends in the longitudinal direction of the base 101 to the central portion in the longitudinal direction.

In general, the term "hourglass shape" mathematically refers to a three-dimensional shape in which a hyperboloid of one sheet is closed on the upper bottom surface and the lower bottom surface. However, the term "hourglass shape" in the present invention refers to a three-dimensional shape in which a hyperboloid of two sheets is closed on side surfaces having predetermined shapes. More specifically, the term "hourglass shape" in the present invention refers to a shape in which a dimension of a base is gradually decreased (i.e., constricted) from an area near two facing ends of the base to a central portion of the base.

When the base 101 has an hourglass shape in this manner, the outer area of the base 101 (the sum of the areas of both end surfaces of the base 101 and the areas of four side surfaces connecting between the end surfaces) is larger than the outer area of a hexahedron having the same dimensions of both end surfaces as the base 101 (hereinafter referred to as "existing structure"). Therefore, the base 101 has a high heat dissipation performance from the outer surfaces. Furthermore, with regard to the laminating direction of the base 101, the thickness from an inner surface of the cavity 18 to an outer surface of the base 101 is smaller than that of the existing structure. Therefore, a temperature gradient between a heat-generating portion of the base 101 and a surface thereof increases, thereby improving the heat dissipation performance. Furthermore, in a state where the ESD protection device 201 is mounted on the printed wiring board P, a gap d between the central portion of the base 101 and the printed wiring board P is larger than that of the existing structure. Therefore, a heat dissipation effect in the lower portion of the base 101 also increases.

Because of the three operations described above, it is possible to easily transmit heat to the surface of the base 101 and dissipate the heat to the outside, the heat being generated at an area near the facing portions of the discharge electrodes 16 (i.e., cavity 18) when a surge current flows. Incidentally, when the base has substantially a barrel shape or a spherical shape, the surface area is increased. However, in such a case, the distance from the facing portions of the electrodes to the surface of the base is increased, and thus the heat dissipating performance is inferior to that in the case where the base has an hourglass shape.

Figure 5B:
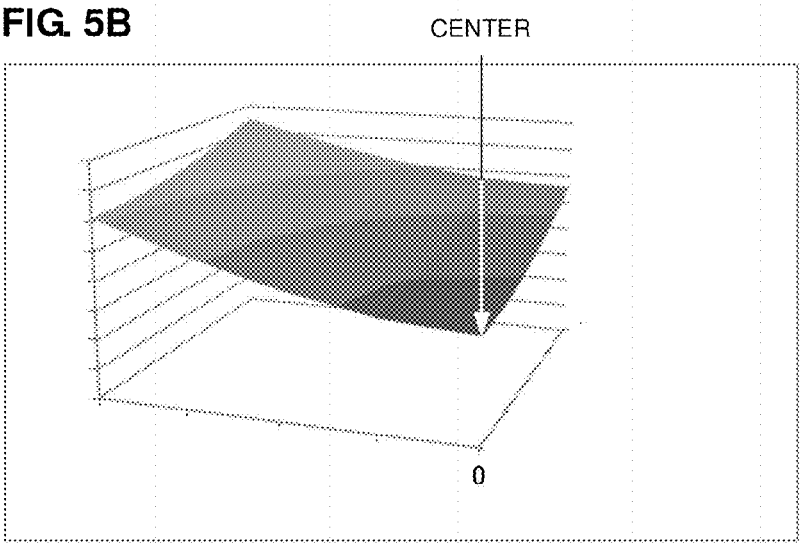
FIG. 5B is a perspective view illustrating a surface perpendicular to a laminating direction of the ESD protection device of the first preferred embodiment of the present invention.
Figure 5C:
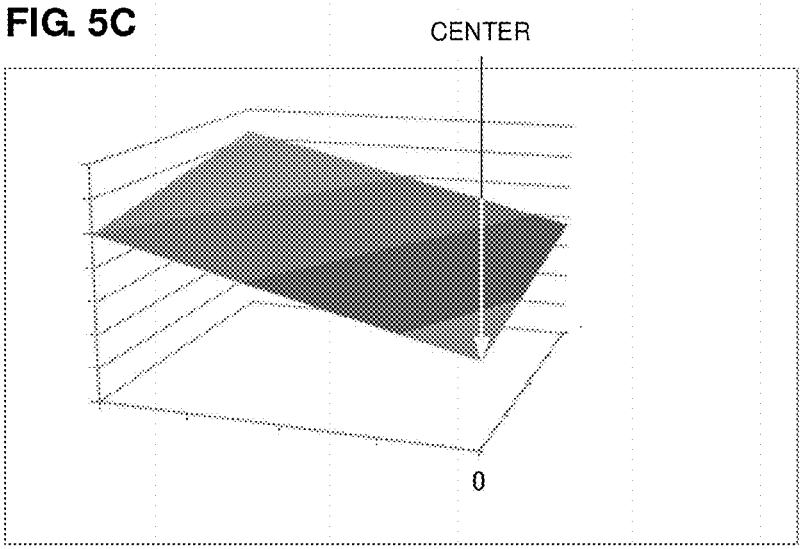
FIG. 5C is a perspective view illustrating a surface perpendicular to a laminating direction of another ESD protection device of the first preferred embodiment of the present invention.

FIG. 5B illustrates a surface profile of a region of about ⅛ of the base surrounded by the cross section taken along line A-A, the cross section taken along line B-B, and the cross section taken along line C-C in FIG. 5A. The central portion of the surface perpendicular to the laminating direction has the shape of a hyperboloid of two sheets. FIG. 5C illustrates another example of a surface profile of a region of ⅛ of a base as in FIG. 5B.

The shape of the base is not particularly limited as long as the surface area of the base is increased and the distance from the facing portions of the electrodes to the surface of the base is decreased. It is sufficient that the central portion of the base is depressed toward the inside in the laminating direction with respect to at least one of the longitudinal cross section passing through the center in the longitudinal direction of the base and the lateral cross section passing through the center in the lateral direction of the base. As illustrated in FIG. 5C, the base may have a shape in which a central portion of a surface of the base is depressed so that a pyramid shape is provided.

In the above-described examples, the base preferably has a shape in which the central portion is depressed toward the inside in the laminating direction with respect to both the longitudinal cross section passing through the center in the longitudinal direction of the base and the lateral cross section passing through the center in the lateral direction of the base. Alternatively, the base may have a shape in which the central portion is depressed toward the inside in the laminating direction with respect to either the longitudinal cross section passing through the center in the longitudinal direction of the base or the lateral cross section passing through the center in the lateral direction of the base.

Next, a non-limiting example of a method for producing the ESD protection device 201 will be described. The production procedure of the ESD protection device 201 is, for example, as follows.

A material having a composition that mainly contains Ba, Al, and Si (BAS material) is preferably used as a ceramic material of insulating ceramic layers 17. Respective raw materials are prepared and mixed so as to have a desired composition, and the mixture is calcined at about 800° C. to about 1,000° C. The resulting calcined powder is pulverized in a zirconia ball mill for 12 hours to prepare a ceramic powder. An organic solvent such as toluene or EKINEN is added to the ceramic powder, and the resulting mixture is mixed. A binder and a plasticizer are further added thereto, and the resulting mixture is mixed to prepare a slurry. The slurry thus obtained is formed by a doctor blade method to prepare ceramic green sheets each having a thickness of about 50 μm, for example.

An electrode paste for forming discharge electrodes is prepared. A solvent is added to about 80% by weight of a Cu powder having an average particle diameter of about 2 μm and a binder resin composed of ethyl cellulose or the like, and the mixture is stirred and mixed with a three roll mill to prepare an electrode paste. Here, the average particle diameter is determined by a laser diffraction scattering method, which is a common measuring method for ceramic powders.

A resin paste functioning as a starting point for forming a cavity 18 is also prepared by a similar method. The resin paste contains only a resin and a solvent. A resin that decomposes and disappears during firing is used as the resin material. Examples of the resin material include polyethylene terephthalate (PET), polypropylene, and an acrylic resin.

The electrode paste is applied onto a ceramic green sheet to form a pattern of discharge electrodes 16 so that the distance between facing portions of the discharge electrodes 16 corresponds to a discharge gap. In this preferred embodiment, the discharge electrodes 16 are formed so that the width of each of the discharge electrodes 16 is about 100 μm, and the width of the discharge gap (the distance between the facing portions) is about 30 μm, for example. Furthermore, the resin paste for forming a cavity is applied thereon.

As in a common ceramic multilayer substrate, ceramic green sheets are laminated and press-bonded to produce a laminate. In this preferred embodiment, ceramic green sheets are laminated so that the thickness after firing is about 0.25 mm, for example, and the facing portions of the discharge electrodes 16 are exposed in the cavity 18 after firing.

As in a chip-type electronic component such as an LC filter, the laminate is cut with a microcutter to be separated into respective bases. In this preferred embodiment, the laminate is cut so that each of the bases has a size of about 1.0 mm×about 0.5 mm. The base after cutting is formed by performing pressing in a die so as to have the hourglass shape illustrated in FIGS. 6A and 6B. Subsequently, the electrode paste to be formed into outer electrodes 11 after firing is applied onto end surfaces of a base 101.

By performing the above pressing in the laminating direction of the ceramic green sheets, i.e., in the thickness direction of the base (in the direction of the smallest dimension among the length, the width, and the thickness of the base), the forming can be easily and efficiently performed.

Next, as in a common ceramic multilayer substrate, firing is performed in a $N_2$ atmosphere. In the case where a noble gas such as Ar or Ne is introduced in the cavity in order to decrease a voltage response to ESD, firing in a temperature range in which the shrinking and sintering of the ceramic material occur may be performed in an atmosphere of a noble gas such as Ar or Ne. In the case where the discharge electrodes 16 and the outer electrodes 11 are composed of an electrode material that is not oxidized, firing may be performed in an air atmosphere.

As in a chip-type electronic component such as an LC filter, a Ni—Sn plating film is formed on the surfaces of the outer electrodes 11 by electrolytic Ni—Sn plating.

The ESD protection device 201 illustrated in FIGS. 5A, 6A, and 6B is produced through the above-described procedure.

The ceramic material used as the base is not particularly limited to the above material. Alternatively, a ceramic material containing another component, for example, a material in which glass is added to forsterite or a material in which glass is added to $CaZrO_3$ may also be used.

The electrode material is also not limited to Cu. Alternatively, the electrode material may be Ag, Pd, Pt, Al, Ni, W, or a combination of these elements.

A resin paste is applied as a starting point for forming a cavity. Alternatively, a material such as carbon which disappears during firing may also be used instead of a resin. Alternatively, a resin may be arranged by, for example, applying a resin film or the like only at a predetermined position instead of preparing a resin paste and applying the resin paste by printing.

As described above, a base after cutting is formed so as to have an hourglass shape by performing pressing in a die. This method is advantageous in that the ESD protection device can be produced at a low cost.

Next, properties of the ESD protection device prepared by the above procedure will be described. In this experiment, 100 ESD protection devices having the conventional structure and 100 ESD protection devices of the first preferred embodiment of the present invention were prepared, and resistance to repeated ESD was examined.

The resistance to repeated ESD was evaluated in accordance with the standard of International Electrotechnical Commission (IEC) (IEC 61000-4-2). A voltage of 8 kV was continuously applied by contact discharge 50 times, 100 times, 300 time, or 500 times. After the continuous application, the occurrence of short-circuit (IR=less than 1 MΩ) was examined. When short-circuit did not occur, the sample was evaluated as good (denoted by "A"). When short-circuit occurred, the sample was evaluated as a defect (denoted by "B"). For the defects, the defective rate (%) was also determined. The results are shown in the table below.

| | Rate of occurrence of short-circuit | | | |
|---|---|---|---|---|
| | 50 times | 100 times | 300 times | 500 times |
| Samples having existing structure | A | B (10%) | B (30%) | B (60%) |
| Samples of the present invention | A | A | A | A |

As is apparent from the table, regarding the ESD protection devices having the existing structure, when the number of times the surge was repeated was 100 or more, the short-circuit defect occurred. In addition, with the increase in the number of times of repetition, the defective rate increased. In contrast, in the first preferred embodiment of the present invention, even when the number of times the surge was repeated was 500, the short-circuit defect did not occur. Thus, according to this preferred embodiment of the present invention, the rate of occurrence of short-circuit could be reduced, and the resistance to repeated ESD could be improved.

In the first preferred embodiment, a description has been made of an example in which the width of the base 101 in the lateral direction gradually increases from an area near both ends in the longitudinal direction of the base 101 to the central portion in the longitudinal direction of the base 101. However, preferably, this width of the base 101 in the lateral direction also gradually decreases from an area near both ends in the longitudinal direction of the base 101 to the central portion in the longitudinal direction of the base 101.

Second Preferred Embodiment

Figure 7A:
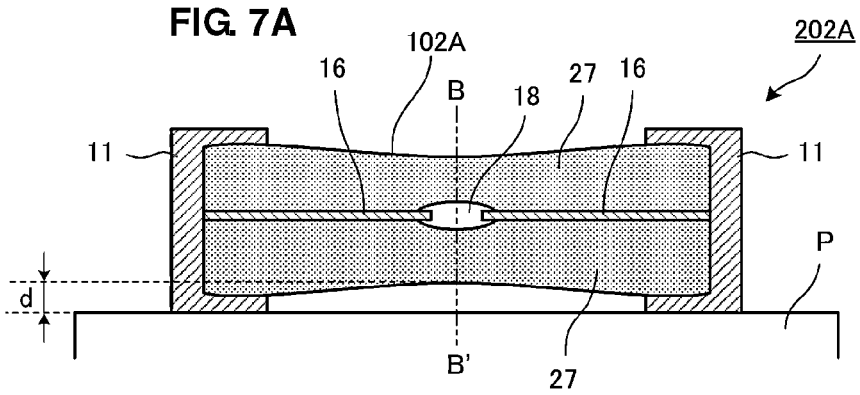
FIG. 7A is a longitudinal cross-sectional view of an ESD protection device 202A of a second preferred embodiment of the present invention in the longitudinal direction.
Figure 7B:
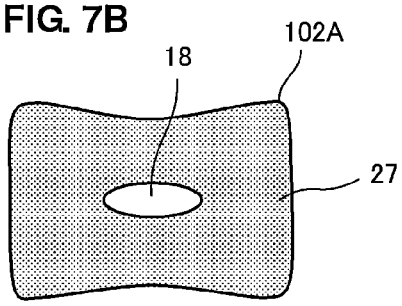
FIG. 7B is a lateral cross-sectional view of the ESD protection device 202A in the lateral direction.

FIG. 7A is a longitudinal cross-sectional view of an ESD protection device 202A of a second preferred embodiment in the longitudinal direction, and FIG. 7B is a lateral cross-sectional view of the ESD protection device 202A in the lateral direction. Line B-B' in FIG. 7A shows the position of the lateral cross section corresponding to FIG. 7B.

Figure 8A:
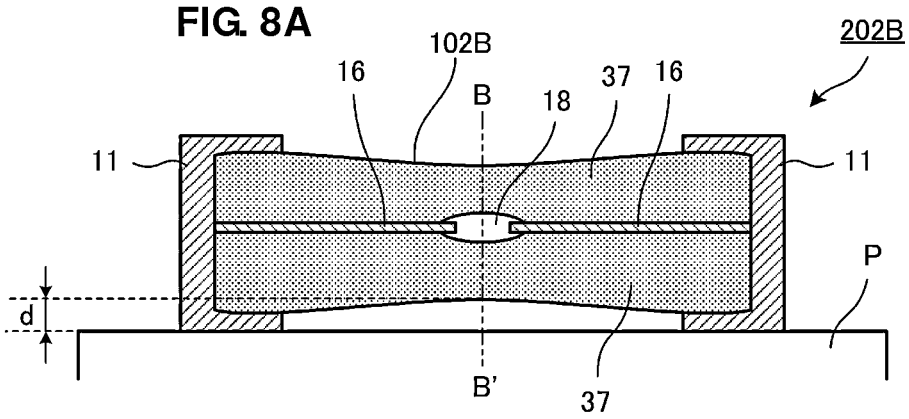
FIG. 8A is a longitudinal cross-sectional view of another ESD protection device 202B of the second preferred embodiment of the present invention in the longitudinal direction.
Figure 8B:
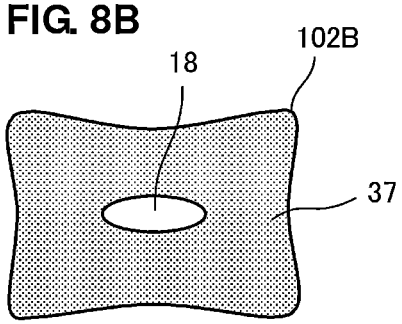
FIG. 8B is a lateral cross-sectional view of the ESD protection device 202B in the lateral direction.

FIG. 8A is a longitudinal cross-sectional view of another ESD protection device 202B of the second preferred embodiment in the longitudinal direction, and FIG. 8B is a lateral cross-sectional view of the ESD protection device 202B in the lateral direction. Line B-B' in FIG. 8A shows the position of the lateral cross section corresponding to FIG. 8B.

The ESD protection device 202A includes a substantially rectangular parallelepiped base 102A in which insulating ceramic layers 27 are laminated, a pair of discharge electrodes 16 that are disposed inside the base 102A and that include facing portions facing each other, and outer electrodes 11 that are disposed on surfaces of the base 102A and that are electrically connected to the discharge electrodes 16. The outer electrodes 11 are disposed on both ends of the base 102A, the ends facing each other. The base 102A includes a cavity 18 therein, and the facing portions of the discharge electrodes 16 are exposed in the cavity 18. The facing portions of the discharge electrodes 16 are located in a central portion (constricted portion) of the base 102A.

The base 102A of the ESD protection device 202A has an hourglass shape in which a dimension of the insulating ceramic layers 27 in the laminating direction (the thickness dimension in a height direction perpendicular to a surface of a printed wiring board P) is gradually decreased (constricted) from an area near both ends of the base 102A to a central portion thereof with respect to both a longitudinal cross section passing through the center in the longitudinal direction of the base 102A and a lateral cross section passing through the center in the lateral direction of the base 102A. Unlike the first preferred embodiment, the width of the base 102A in the lateral direction (the width extending in a direction parallel to a mounting surface on the printed wiring board P) is substantially uniform with respect to a position in the height direction perpendicular to the mounting surface on the printed wiring board P.

With regard to the ESD protection device 202B, a base 102B of the ESD protection device 202B has an hourglass shape in which a dimension of the insulating ceramic layers 37 in the laminating direction is gradually decreased (constricted) from an area near both ends of the base 102B to a central portion thereof with respect to both a longitudinal cross section passing through the center in the longitudinal direction of the base 102B and a lateral cross section passing through the center in the lateral direction of the base 102B. In addition, as illustrated in FIG. 8B, regarding a width of the base 102B in the lateral direction, the width in a central portion is smaller than the width of the upper surface and the width of the lower surface with respect to a position in the height direction perpendicular to a mounting surface on a printed wiring board P. Other structures are preferably the same or substantially the same as those of the first preferred embodiment.

The width of each of the bases 102A and 102B in the lateral direction may gradually increase from an area near both ends in the longitudinal direction to the central portion in the longitudinal direction. However, preferably, this width in the lateral direction also gradually decreases from an area near both ends in the longitudinal direction to the central portion in the longitudinal direction.

Third Preferred Embodiment

Figure 9A:
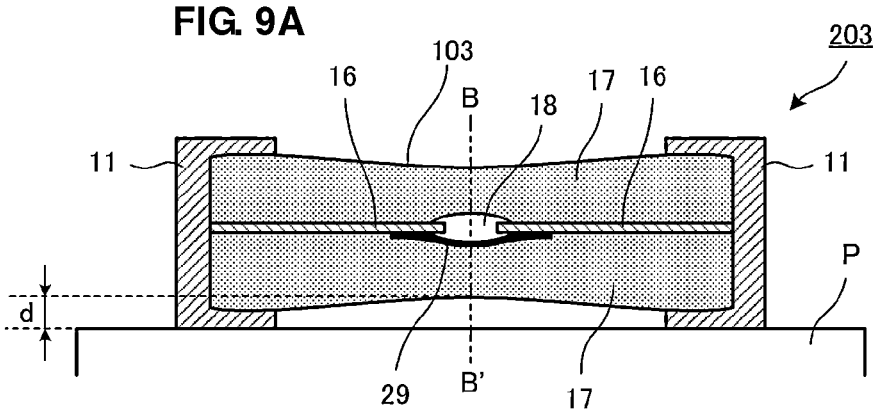
FIG. 9A is a longitudinal cross-sectional view of an ESD protection device 203 of a third preferred embodiment of the present invention in the longitudinal direction.
Figure 9B:
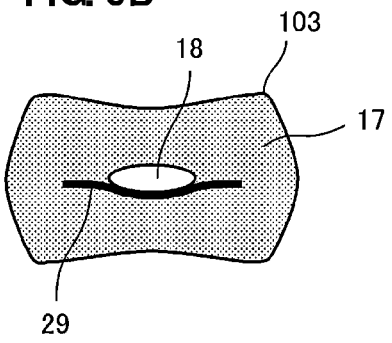
FIG. 9B is a lateral cross-sectional view of the ESD protection device 203 in the lateral direction.

FIG. 9A is a longitudinal cross-sectional view of an ESD protection device 203 of a third preferred embodiment in the longitudinal direction, and FIG. 9B is a lateral cross-sectional view of the ESD protection device 203 in the lateral direction. Line B-B' in FIG. 9A shows the position of the lateral cross section corresponding to FIG. 9B.

In the first and second preferred embodiments, the constricted shape of the base is formed by performing pressing in a die. In the third preferred embodiment, the constricted shape is obtained by using a material having a sintering shrinkage behavior different from that of a ceramic material of the laminate (hereinafter referred to as "shrinkage-behavior-changed material").

The ESD protection device 203 includes a substantially rectangular parallelepiped base 103 in which insulating ceramic layers 17 are laminated, a pair of discharge electrodes 16 that are disposed inside the base 103 and that include facing portions facing each other, and outer electrodes 11 that are disposed on surfaces of the base 103 and that are electrically connected to the discharge electrodes 16. The outer electrodes 11 are disposed on both ends of the base 103, the ends facing each other in the longitudinal direction. The base 103 includes a cavity 18 therein, and the facing portions of the discharge electrodes 16 are exposed in the cavity 18. The facing portions of the discharge electrodes 16 are located in a central portion (constricted portion) of the base 103. Unlike the ESD protection device described in the first preferred embodiment, in the ESD protection device 203 illustrated in FIGS. 9A and 9B, a shrinkage-behavior-changed material 29 is provided along an inner surface of the cavity 18.

Next, a method for producing the ESD protection device 203 will be described. The production procedure of the ESD protection device 203 is, for example, as follows.

Ceramic materials are prepared as in the first preferred embodiment.

A paste for the shrinkage-behavior-changed material 29 is also prepared by the same method as used for preparing other pastes. A material whose sintering shrinkage occurs later than the sintering shrinkage of the ceramic material of the insulating ceramic layers is preferably used as the paste for the shrinkage-behavior-changed material 29. Examples of such a material include alumina and a mixture of a BAS material and alumina. Alumina is sintered at about 1,300° C. to about 1,400° C., whereas the BAS material is sintered at about 1,000° C. or lower, for example. Accordingly, regarding a mixture of these two materials, when the sintering of the BAS material starts, an alumina powder is taken in the BAS material, resulting in a delay of sintering shrinkage. The degree of delay of the sintering shrinkage is determined by controlling the ratio of the BAS material to alumina.

The paste for the shrinkage-behavior-changed material 29 is applied onto an underlying green sheet. Subsequently, an electrode paste and a resin paste are applied. Other conditions are the same as those in the first preferred embodiment.

Lamination and press-bonding are performed as in the first preferred embodiment.

Cutting and application of electrodes to end surfaces are performed by fundamentally the same method as described with respect to the first preferred embodiment. However, the pressing in a die is not performed.

Firing is performed as in the first preferred embodiment.

Plating is performed as in the first preferred embodiment.

In the firing step of the above production procedure, the sintering shrinkage of the shrinkage-behavior-changed material 29 occurs later than the sintering shrinkage of the ceramic material of the insulating ceramic layers 17. As viewed in the cross section of FIG. 9A, with regard to the shrinkage of the base 103 in the longitudinal direction, the shrinkage of the insulating ceramic layers 17 starts before the shrinkage of the shrinkage-behavior-changed material 29. That is, the shrinkage-behavior-changed material 29 functions so as to suppress the shrinkage in the longitudinal direction at the center in the height direction of the base 103. Consequently, the thickness of the base 103 in the laminating direction gradually decreases from both ends in the longitudinal direction of the base 103 to a central portion in the longitudinal direction of the base 103.

As viewed in the cross section of FIG. 9B, with regard to the shrinkage of the base 103 in the lateral direction, the shrinkage of the insulating ceramic layers 17 starts before the shrinkage of the shrinkage-behavior-changed material 29. That is, the shrinkage-behavior-changed material 29 functions so as to suppress the shrinkage in the lateral direction at the center in the height direction of the base 103. Consequently, the thickness of the base 103 in the laminating direction gradually decreases from both ends in the lateral direction of the base 103 to a central portion in the lateral direction of the base 103.

Since the above-described action of the shrinkage behavior is utilized, the sintering shrinkage behavior of the ceramic material of the laminate can be appropriately changed in accordance with the material, dimensions, and arrangement position of the shrinkage-behavior-changed material 29 and a desired constricted shape can be obtained. As a result, the same advantages as those described in the first preferred embodiment can be achieved.

Instead of applying a paste for the shrinkage-behavior-changed material 29, a green sheet composed of the shrinkage-behavior-changed material 29 may be laminated and press-bonded. The arrangement position of the shrinkage-behavior-changed material 29 is not limited to the above example. For example, the shrinkage-behavior-changed material 29 may be arranged in a portion of the cavity 18. Alternatively, the shrinkage-behavior-changed material 29 may be arranged at the periphery of the cavity 18.

In this third preferred embodiment, an hourglass shape is formed by arranging, on an insulating ceramic layer, a material whose sintering shrinkage occurs later than the sintering shrinkage of the ceramic material of the insulating ceramic layer. This method is advantageous in that the shape of the base can be formed with high accuracy.

Fourth Preferred Embodiment

Figure 10A:
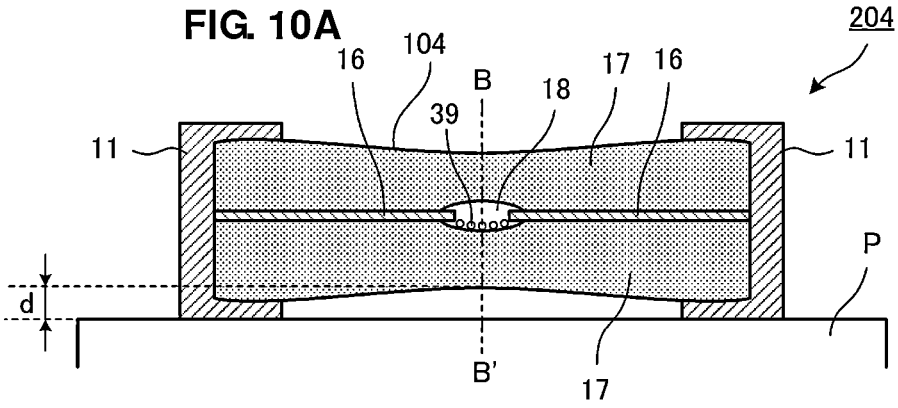
FIG. 10A is a longitudinal cross-sectional view of an ESD protection device 204 of a fourth preferred embodiment of the present invention in the longitudinal direction.
Figure 10B:
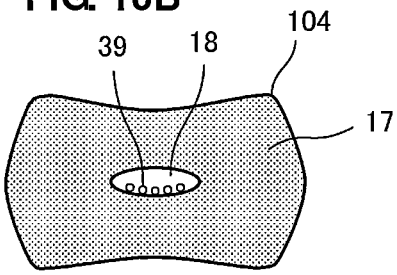
FIG. 10B is a lateral cross-sectional view of the ESD protection device 204 in the lateral direction.

FIG. 10A is a longitudinal cross-sectional view of an ESD protection device 204 of a fourth preferred embodiment in the longitudinal direction, and FIG. 10B is a lateral cross-sectional view of the ESD protection device 204 in the lateral direction. Line B-B' in FIG. 10A shows the position of the lateral cross section corresponding to FIG. 10B.

The fourth preferred embodiment differs from the first preferred embodiment in the structure of a discharge portion. The ESD protection device 204 of the fourth preferred embodiment includes an auxiliary discharge electrode 39 in a cavity 18. The auxiliary discharge electrode 39 is arranged so as to be adjacent to at least facing portions of discharge electrodes 16 and a portion between the facing portions.

The auxiliary discharge electrode 39 is a mixture containing conductive particles and either insulating particles or semiconductor particles. Alternatively, the auxiliary discharge electrode 39 is a mixture containing conductive particles, insulating particles, and semiconductor particles.

Figure 11:
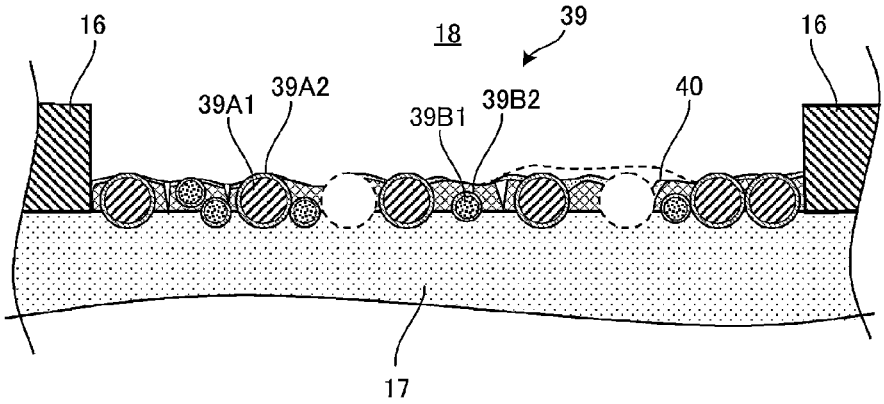
FIG. 11 is an enlarged schematic view illustrating a cross-sectional structure of a discharge portion.

FIG. 11 is an enlarged schematic view illustrating a cross-sectional structure of the discharge portion. In this example, an insulating ceramic layer 17 is composed of alumina, and an auxiliary discharge electrode 39A has a particle diameter larger than that of an auxiliary discharge electrode 39B. The auxiliary discharge electrodes 39A and 39B may fill the interface between the cavity 18 and the insulating ceramic layer 17 and the inside of the insulating ceramic layer 17 near the interface.

The auxiliary discharge electrode 39 includes particulate metal material 39A1 and an insulating film 39A2 provided on the surface of the metal material 39A1. The auxiliary discharge electrode 39 also includes particulate semiconductor material 39B1 and an insulating film 39B2 provided on the surface of the semiconductor material 39B1. In this example, the metal material 39A1 is a Cu particle, and the semiconductor material 39B1 is a SiC particle. The insulating film 39A2 is an alumina film, and the insulating film 39B2 is a $SiO_2$ film formed by oxidizing the semiconductor material 39B1.

Furthermore, a glass-like substance 40 is formed inside the cavity 18 so as to surround the auxiliary discharge electrodes 39A and 39B. The glass-like substance 40 is not intentionally formed but is formed by a reaction such as oxidation of, for example, a material derived from a peripheral component of a sacrificial layer used for forming the cavity 18.

Next, a method for producing the ESD protection device 204 will be described. The production procedure of the ESD protection device 204 is, for example, as follows.

Ceramic materials are prepared as in the first preferred embodiment.

A mixed paste for forming an auxiliary discharge electrode is prepared as follows. A Cu powder functioning as a conductive material and having an average particle diameter of about 3 μm and a BAS powder functioning as a ceramic material and having an average particle diameter of about 1 μm are mixed in a predetermined ratio. A binder resin and a solvent are added thereto, and the resulting mixture is stirred and mixed with a three roll mill to prepare a mixed paste. In the mixed paste, the content of the binder resin and the solvent is about 20% by weight and the content of the Cu powder and the BAS powder is about 80% by weight, for example.

First, the mixed paste is applied onto an underlying green sheet. An electrode paste and a resin paste are then applied. Alternatively, the mixed paste may be applied onto a shrinkage-behavior-changed material applied onto a green sheet, and an electrode paste and a resin paste may then be applied thereon.

Lamination and press-bonding are performed as in the first preferred embodiment.

Cutting and application of electrodes to end surfaces are performed as in the first preferred embodiment.

Firing is performed as in the first preferred embodiment.

Plating is performed as in the first preferred embodiment.

The ceramic material used in the mixed paste for forming the auxiliary discharge electrode is not particularly limited to the above material. Alternatively, a ceramic material containing another component, for example, a material in which glass is added to forsterite or a material in which glass is added to $CaZrO_3$ may also be used. From the standpoint of suppressing delamination, the ceramic material contained in the mixed paste is preferably the same as the ceramic material forming at least one of the insulating ceramic layers. From the standpoint of ESD responsiveness, the ceramic material is preferably a semiconductor ceramic. Examples of the semiconductor ceramic include carbides such as silicon carbide, titanium carbide, zirconium carbide, molybdenum carbide, and tungsten carbide; nitrides such as titanium nitride, zirconium nitride, chromium nitride, vanadium nitride, and tantalum nitride; silicides such as titanium silicide, zirconium silicide, tungsten silicide, molybdenum silicide, and chromium silicide; borides such as titanium boride, zirconium boride, chromium boride, lanthanum boride, molybdenum boride, and tungsten boride; and oxides such as zinc oxide and strontium titanate. Among these semiconductor ceramics, silicon carbide is particularly preferable from the standpoint that the cost is relatively low and powders having various particle diameters are commercially available. These semiconductor ceramics may be used alone or in combination of two or more semiconductor ceramics, as required. These semiconductor ceramics may be used as a mixture with insulating ceramic materials such as alumina and a BAS material, as required.

The conductive material used in the mixed paste to form the auxiliary discharge electrode is also not limited to Cu. Alternatively, the conductive material may be Ag, Pd, Pt, Al, Ni, W, or a combination of these elements. A conductive material coated with an inorganic material may also be used. In this case, the coating material is not particularly limited as long as the coating material is an inorganic material. For example, the coating material may be an inorganic material such as $Al_2O_3$, $ZrO_2$, or $SiO_2$, or a mixed calcined material such as a BAS material. Alternatively, the coating material may be a semiconductor ceramic material. From the standpoint of suppressing delamination, the coating material preferably contains the same component as the ceramic material described above or at least an element contained in the ceramic material or the insulating ceramic layers. The metal material to be coated with the inorganic material is also not limited to Cu, and may be Ag, Pd, Pt, Al, Ni, W, or a combination of these elements. It is preferable to optimize the amount of coating in accordance with the shrinkage behavior as in a mixed ceramic powder.

The mixed material of a metal and a ceramic may be arranged in the form of a sheet, instead of a paste.

The auxiliary discharge electrode need not contain all conductive particles, insulating particles, and semiconductor particles. The auxiliary discharge electrode may contain conductive particles and either insulating particles or semiconductor particles.

Fifth Preferred Embodiment

Figure 12A:
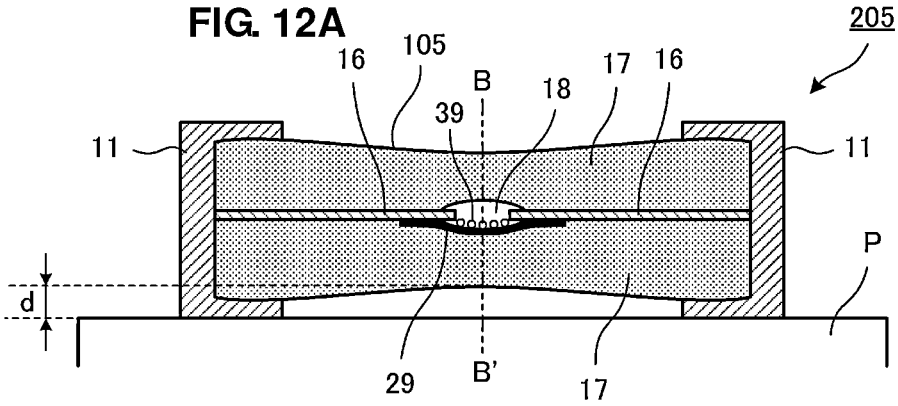
FIG. 12A is a longitudinal cross-sectional view of an ESD protection device 205 of a fifth preferred embodiment of the present invention in the longitudinal direction.
Figure 12B:
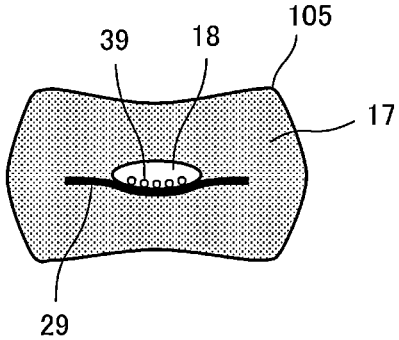
FIG. 12B is a lateral cross-sectional view of the ESD protection device 205 in the lateral direction.

FIG. 12A is a longitudinal cross-sectional view of an ESD protection device 205 of a fifth preferred embodiment in the longitudinal direction, and FIG. 12B is a lateral cross-sectional view of the ESD protection device 205 in the lateral direction. Line B-B' in FIG. 12A shows the position of the lateral cross section corresponding to FIG. 12B.

The ESD protection device 205 of the fifth preferred embodiment differs from the ESD protection device of the fourth preferred embodiment illustrated in FIGS. 10A and 10B in that a base having a constricted shape is obtained by using a material having a sintering shrinkage behavior different from that of a ceramic material of a laminate (shrinkage-behavior-changed material).

In this manner, a shrinkage-behavior-changed material 29 may be used in the ESD protection device including an auxiliary discharge electrode 39.

Sixth Preferred Embodiment

Figure 13A:
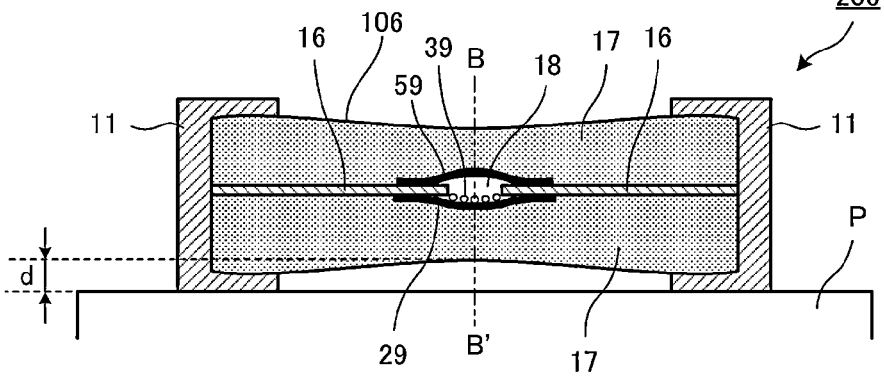
FIG. 13A is a longitudinal cross-sectional view of an ESD protection device 206 of a sixth preferred embodiment of the present invention in the longitudinal direction.
Figure 13B:
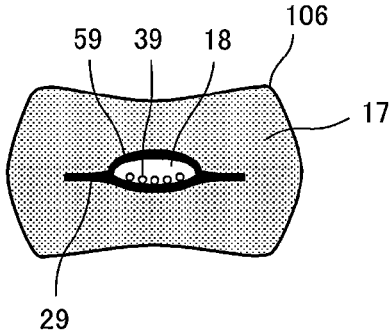
FIG. 13B is a lateral cross-sectional view of the ESD protection device 206 in the lateral direction.

FIG. 13A is a longitudinal cross-sectional view of an ESD protection device 206 of a sixth preferred embodiment in the longitudinal direction, and FIG. 13B is a lateral cross-sectional view of the ESD protection device 206 in the lateral direction. Line B-B' in FIG. 13A shows the position of the lateral cross section corresponding to FIG. 13B.

The ESD protection device 206 of the sixth preferred embodiment differs from the ESD protection device of the fifth preferred embodiment illustrated in FIGS. 12A and 12B in that a material having a sintering shrinkage behavior different from that of a ceramic material of a laminate (shrinkage-behavior-changed material) is arranged around a cavity 18.

In this sixth preferred embodiment, a shrinkage-behavior-changed material 29 is arranged along the lower portion of the cavity 18, and a shrinkage-behavior-changed material 59 is arranged along the upper portion of the cavity 18. By arranging the shrinkage-behavior-changed materials 29 and 59 in the central portion of a base 106 in this manner, the thickness of the base 106 in the laminating direction is gradually decreased from both ends in the longitudinal direction of the base 106 to a central portion in the longitudinal direction of the base 106, and the thickness of the base 106 in the laminating direction is gradually decreased from both ends in the lateral direction of the base 106 to a central portion in the lateral direction of the base 106.

In this sixth preferred embodiment, since the shrinkage-behavior-changed materials 29 and 59 are arranged around the cavity 18, the constricted shape of the base 106 can be effectively provided.

Seventh Preferred Embodiment

Figure 14A:
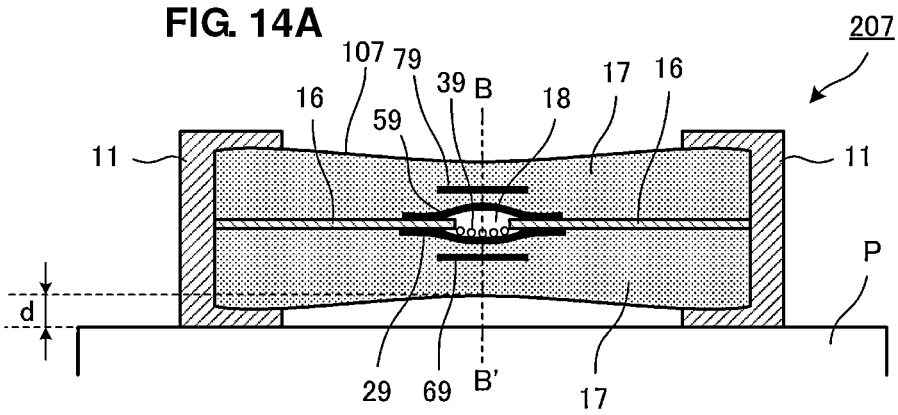
FIG. 14A is a longitudinal cross-sectional view of an ESD protection device 207 of a seventh preferred embodiment of the present invention in the longitudinal direction.
Figure 14B:
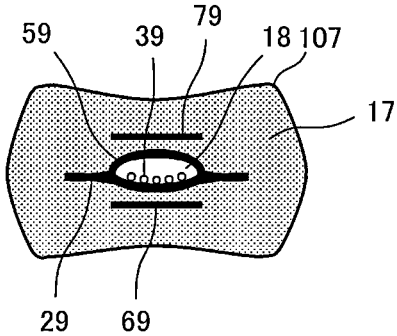
FIG. 14B is a lateral cross-sectional view of the ESD protection device 207 in the lateral direction.

FIG. 14A is a longitudinal cross-sectional view of an ESD protection device 207 of a seventh preferred embodiment in the longitudinal direction, and FIG. 14B is a lateral cross-sectional view of the ESD protection device 207 in the lateral direction. Line B-B' in FIG. 14A shows the position of the lateral cross section corresponding to FIG. 14B.

The ESD protection device 207 of the seventh preferred embodiment is the same as the ESD protection devices described in the above preferred embodiments except that shrinkage-behavior-changed materials 29, 59, 69, and 79 are arranged in the central portion of a base 107 in the form of a plurality of layers.

In this seventh preferred embodiment, since a larger number of shrinkage-behavior-changed materials 29, 59, 69, and 79 are arranged in the central portion of the base 107, the constricted shape of the base 107 can be more effectively formed.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An electro-static discharge protection device comprising:

a substantially rectangular parallelepiped base in which insulating ceramic layers are laminated;

at least one pair of discharge electrodes located inside the base and including facing portions facing each other; and outer electrodes located on surfaces of the base and electrically connected to the discharge electrodes; wherein the base has a shape in which, among outer surfaces of the base, a central portion of an outer surface substantially perpendicular to a laminating direction of the insulating ceramic layers is depressed toward an inside of the base in the laminating direction with respect to at least one of a longitudinal cross section passing through a center in a longitudinal direction of the base and a lateral cross section passing through a center in a lateral direction of the base.

2. The electro-static discharge protection device according to claim 1, wherein the base has a shape in which, among the outer surfaces of the base, central portions of two outer surfaces substantially perpendicular to the laminating direction of the insulating ceramic layers are depressed toward the inside of the base in the laminating direction.

3. The electro-static discharge protection device according to claim 1, wherein the base includes a cavity therein, the facing portions of the discharge electrodes are exposed in the cavity, and the facing portions of the discharge electrodes are located in a central portion of the base.

4. The electro-static discharge protection device according to claim 1, further comprising:

an auxiliary discharge electrode arranged so as to be adjacent to at least the facing portions of the discharge electrodes and a portion between the facing portions; wherein the auxiliary discharge electrode includes conductive particles and at least one of insulating particles and semiconductor particles.

5. The electro-static discharge protection device according to claim 4, wherein the conductive particles are particles including surfaces that are coated with an insulating material.

6. A method for producing an electro-static discharge protection device, the method comprising:

a discharge electrode formation step of forming a pair of discharge electrodes facing each other on at least one of a surface of a first insulating ceramic layer and a surface of a second insulating ceramic layer;

an auxiliary discharge electrode material-providing step of allowing an auxiliary discharge electrode material to adhere between facing portions of the discharge electrodes;

a laminating step of laminating the first insulating ceramic layer and the second insulating ceramic layer in a state in which the surface of the first insulating ceramic layer and the surface of the second insulating ceramic layer face each other to form a laminate;

a dividing step of dividing the laminate into individual bases;

an outer electrode formation step of forming outer electrodes that are electrically connected to the discharge electrodes on surfaces of a base obtained in the dividing step; and a firing step of firing the base including the outer electrodes thereon to form a cavity between the first insulating ceramic layer and the second insulating ceramic layer so that an end of each of the discharge electrodes is exposed in the cavity and to disperse the auxiliary discharge electrode material in the cavity; wherein the method includes a constriction step of depressing, among outer surfaces of the base, a central portion of an outer surface substantially perpendicular to a laminating direction of the insulating ceramic layers toward an inside of the base in the laminating direction with respect to at least one of a longitudinal cross section passing through a center in a longitudinal direction of the base and a lateral cross section passing through a center in a lateral direction of the base.

7. The method according to claim 6, wherein the constriction step is a step of pressing the base in a die, the constriction step being performed before firing in the firing step.

8. The method according to claim 6, wherein the constriction step is a step of arranging, on at least one of the first insulating ceramic layer and the second insulating ceramic layer, a material whose sintering shrinkage occurs later than the sintering shrinkage of a ceramic material of the first insulating ceramic layer and the second insulating ceramic layer.

* * * * *